United States Patent [19]

Guyot

[11] Patent Number: 4,697,545

[45] Date of Patent: Oct. 6, 1987

[54] DENDRITE GENERATOR

[76] Inventor: Morel D. Guyot, 3585 Beverly Glen, Sherman Oaks, Calif. 91423

[21] Appl. No.: 809,122

[22] Filed: Dec. 16, 1985

[51] Int. Cl.[4] ..... B05B 5/02

[52] U.S. Cl. ..... 118/624; 118/636; 118/638

[58] Field of Search ..... 118/624, 625, 636, 638; 427/14.1

[56] References Cited

U.S. PATENT DOCUMENTS 705,691 7/1902 Morton ..... 118/636 X 2,097,233 10/1937 Meston ..... 118/624

*Primary Examiner*—Evan K. Lawrence

*Attorney, Agent, or Firm*—Roger A. Marrs

[57] ABSTRACT

A generator is disclosed herein for producing dendriform patterns or designs on a substrate workpiece employing an electrical device for charging a liquid as it flows between the oppositely charged electrodes over the substrate. The dendriform pattern, shape and growth is controlled by liquid composition, applied voltages, temperature devices, vibratory devices and the like. The electrodes are disposed in fixed spaced relationship over the surface of non-conductive substrate so that the liquid is charged assuming the characteristics of one polarity while a field of opposite polarity is present at the other electrode. The gravity flow of the charged liquid introduces new liquid to the electrode and the counter reacting force field creates the molecular array of dendriform patterns.

9 Claims, 5 Drawing Figures

DENDRITE GENERATOR

BACKGROUND OF THE INVENTION

1. Field of the Invention

The present invention relates to the creation of graphic materials and more particularly to a novel generator for producing unusual and unique graphic representations incorporating dendriform patterns and designs.

2. Brief Description of the Prior Art

As the creativeness of modern artistry has expanded with the increases of technological improvement and with the widening demand, both commercially and industrially, for electronic devices capable of providing automatic graphic and artistic rendering in both musical and art form endeavors, the need for simple and reliable electric devices capable of artistic control has become of increasing importance. A concomitant of this modern trend is the need in the graph arts industry for producing an artistic rendering which is unobtainable using conventional art supplies and implements such as brushes, palette knife or the like.

Problems and difficulties have been encountered when using conventional implements which stem largely from the fact that such implements cannot create tiny dendriform patterns as natural looking trees, snowflakes, spider web-like designs, fern type renderings or similar patterns. Dendrite forms present branch-like designs that look like natural trees which cannot be drawn by the human hand.

Therefore, a long standing need has existed to provide a novel means and method of producing dendriform patterns and designs without the employment of conventional implements and manual manipulation thereof.

SUMMARY OF THE INVENTION

Accordingly, the above problems and difficulties are obviated by the present invention which provides a novel generating means for creating dendriform patterns constituting an artistic rendering that comprises a non-conductive substrate supporting a quantity of liquid introduced thereto by a dispensing nozzle under gravity feed. Electrodes arranged in fixed spaced apart relationship electrically charge the liquid and diffuse the quantity of liquid into varying minute thickness representing branch-like or tree-like forms. Conditioning means are operably disposed adjacent to the liquid during its diffusion to augment or increase the effect of dendriform pattern creation. Such means may take the form of temperature devices, vibration means, displacement means for the substrate and the like.

Therefore, it is among the primary objects of the present invention to provide a novel means for creating artistic dendriform patterns on a substrate suitable for visual presentation.

Another object of the present invention is to provide a generator for producing unusual graphics displaying tree-like or spider web-like forms.

Still another object of the present invention is to provide a dendrite generator producing patterns which appear like snowflakes, ferns, flames, branches or the like on a mounting substrate that are artistic and original.

Yet another object of the present invention is to provide a novel means and method of producing an unusual art form employing electrical charges and force fields for spreading a charged medium over a mounting substrate in a pattern representing dendriform designs having varying characteristics.

Another object of the present invention to provide a novel electrical means and method for creating a pattern of interconnecting dendriform and micro-dendriform designs employing an initially flowable fluid that penetrates and bonds to a substrate in a solidified condition.

Another object resides in a novel electrical means for providing an artistic display of combined dendriform and micro-dendriform designs employing an electrostatic coaction or pumping action of a charged fluid medium to distribute the medium over a supporting substrate.

BRIEF DESCRIPTION OF THE DRAWINGS

The features of the present invention which are believed to be novel are set forth with particularity in the appended claims. The present invention, both as to its organizatin and manner of operation, together with further objects and advantages thereof, may best be understood by reference to the following description, taken in connection with the accompanying drawings in which:

DESCRIPTION OF THE PREFERRED EMBODIMENTS

Figure 1:
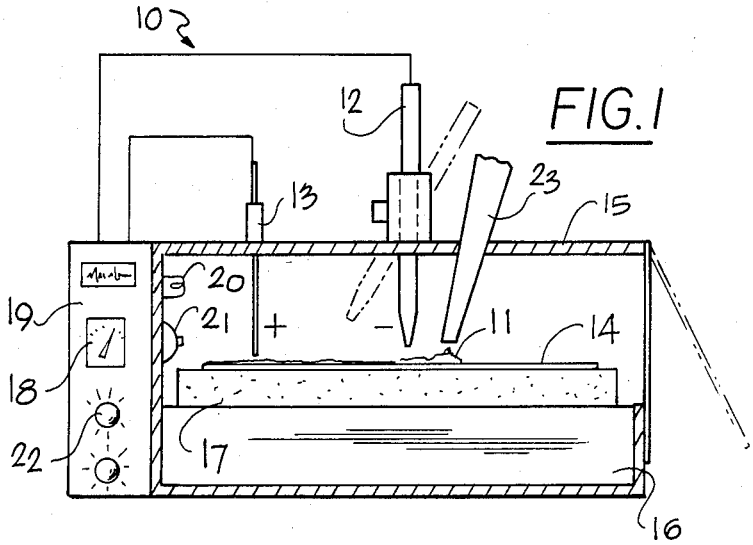
FIG. 1 is a diagrammatic illustration of the novel dendrite generator incorporating the present invention.

The dendrite generator of the present invention is illustrated in the general direction of arrow 10 which is a device for creating natural looking tree-like patterns that are difficult to create by conventional methods of art such as through the use of brushes. The invention uses electricity coupled with special conditioning means affecting temperature, vibration or the like to generate the dendriform. The dendriforms or dendrites are generally referred to as branch-like forms which look like natural trees, spider webs or the like. The human hand cannot draw such patterns that are as natural looking as electrically generated dendrites through the use of the present invention.

In general, an initially flowable liquid such as indicated by numeral 11 is charged electrically by means of an electrode 12 and then caused to flow towards an oppositely charged electrode 13 over a non-conductive substrate 14. The substrate 14 may be curved or flat and may take the form of plastic, glass, canvas or other electrically insulative material. As the liquid travels over the non-conductive substrate 14, it grows or disperses into dendriform patterns, the shape and size of the dendriform patterns are controlled by the composition of the liquid, the substrate material, voltage type of electric field, temperature, and other arrangement to be described later. The charged liquid is distributed over the surface of the substrate through electrostatic coaction with the electrodes whereby a type of pumping action is provided to the liquid molecules which are pulled or streched in a migratory or diffusive manner.

In one form of the invention, the apparatus or generator 10 includes a cabinet 15 which includes a base 16 which supports an electrically non-conducting or an insulative platform 17. The substrate 14 is supported on the platform 17 within the cavity of the cabinet 15. The cabinet further includes a control section 19 having meters, display units and other indicators generally illustrated by numeral 18 for visually indicating conditions within the chamber or cavity of the cabinet. For example, the meters may show voltages present at the electrodes 12 and 13 as well as temperatures conditions within the chamber as picked up by a thermocouple 20. Also, conditions within the chamber may be modified by discharging an inert gas via a nozzle 21. A variety of control knobs such as knob 22 may be used for changing a variety of conditions such as tilting or vertically slanting the electrode 12 into another orientation as shown in broken lines. Mechanism suitable for such tilting is conventional and may be achieved manually by the operator. Through the use of an inert atmosphere within the cavity, spurious ignition or random sparking of the electrodes is greatly reduced or eliminated.

Humidity within the chamber affects controls and, preferably, the interior should be maintained as dry as possible. Through the use of a heater controlled by the thermocouple 20, humidity can be modified. Also, if desired, the creation or generation of the dendriform patterns can be done under vacuum conditions or reduced pressure or in ambient or increased pressure conditions. All of these means may be achieved through the use of conventional equipment properly attached to the cabinet 15.

The liquid 11 may be caused to flow over the sustrate 14 by any suitable means; however, with respect to FIG. 1, such a means includes dispensing the liquid into the work chamber by means of a spout 23 under pressure of gravity feed so that the liquid will flow beneath electrode 12 and continue to flow in the direction of electrode 13. Since the dispensing nozzle 23 is in close proximity to electrode 12, the liquid 11 will be ionized or electrostatically charged according to the polarity of the electrode 12. In the present instance, the electrode is negative so that the liquid will assume a negative charge polarity and accompanying force field. The positive polarity of the charge placed on electrode 13 will attract and cause dispersal or spreading of the fluid or liquid 11 as it approaches the electrode. Curing of the liquid, such as by drying, occurs as it spreads so that adherence to the substrate 14 takes place. In fact, in some instances, fluid penetrates into the substrate surface for greater adhesion and bonding thereto.

Another variable which affects the creation or growth of the dendriform patterns resides in the vibration of the substrate 14 so that the liquid or fluid 11 is more controllably dispersed as it travels over the substrate under the influence of the electrodes.

Figure 3:
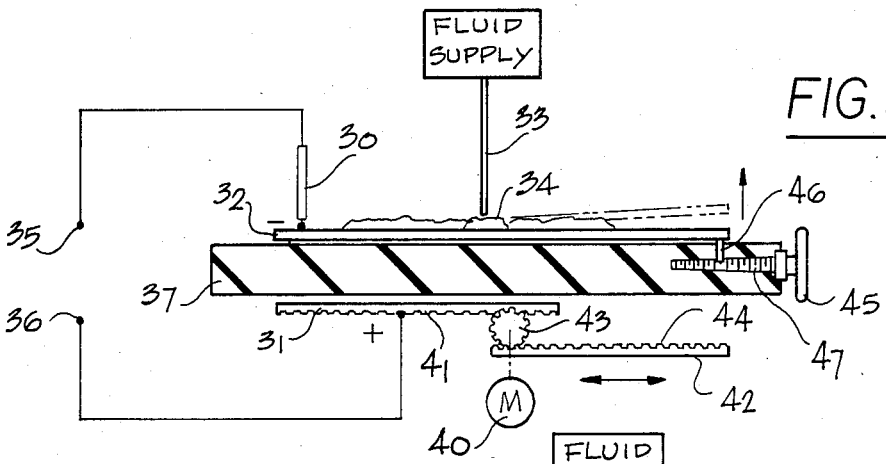
FIG. 3–5 are diagrammatic views of other embodiments of the present invention.

Referring now in detail to FIG. 3, another embodiment of the invention is illustrated wherein the dendrite generator is composed of oppositely charged electrodes 30 and 31 which are facing each other and separated by a conductive substrate 32. The liquid is introduced to the substrate surface 32 via a dispenser 33 and is charged to a given polarity. The charged liquid is indicated in general by the numeral 34. Voltage to the electrodes 30 and 31 is supplied from a power source which is connected between the terminals 35 and 36 and a non-conductive body 37 is disposed between the charged substrate 32 and the electrode 31 to prevent electrical cross over or arcing. It is also to be noted that the dendriform patterns can be substantially defined, altered or changed by moving one of the electrical force fields with respect to the other. In FIG. 3, a motor 40 is used for moving one of a pair of electrode plates with respect to the other. One plate is indicated by numeral 41 while the other plate is indicated by numeral 42. It is understood that plates 41 and 42 comprise the electrode 31. The motor 40 moves the plates relative to one another by means of a gear or cog wheel 43 disposed between the opposing surfaces of the plates and which is in connection therewith by means of a rack or set of gear teeth such as teeth 44 carried on the surface of plate 42.

Pattern growth can also be controlled by electrically connecting liquid dispenser 33 with electrode 30 so that the charged liquid will be moved or pulled in a direction away from the area between the electrode 30 and the dispenser 33.

The charged substrate 32 may be readily tilted by means of a turning wheel 45 that moves a gate 46 in an up-and-down manner via a lead screw 47. By this means, one end of the plate 32 may be elevated as shown in broken lines so that the fluid or liquid 34 will move on the surface of the charged substrate 32.

Figure 4:
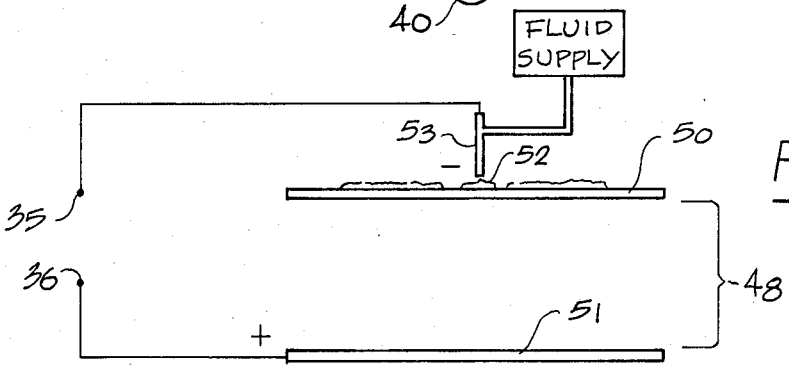

In FIG. 4, a similar arrangement to FIG. 3 is illustrated with the exception of an air gap broadly indicated by numeral 48 is disposed between the plates 50 and 51 so as to constitute an insulator or non-conductive separation. The plates 50 and 51 are separated to the extent that no arcing or sparking will occur therebetween. The substrate 50 carries the liquid 52 thereon and the dispenser for the liquid is indicated by numeral 53 which is attached to a source of power via terminals 35 and 36 so as to charge the liquid as it is being dispensed. The electrode plate 51 is attached to terminal 36.

Figure 5:
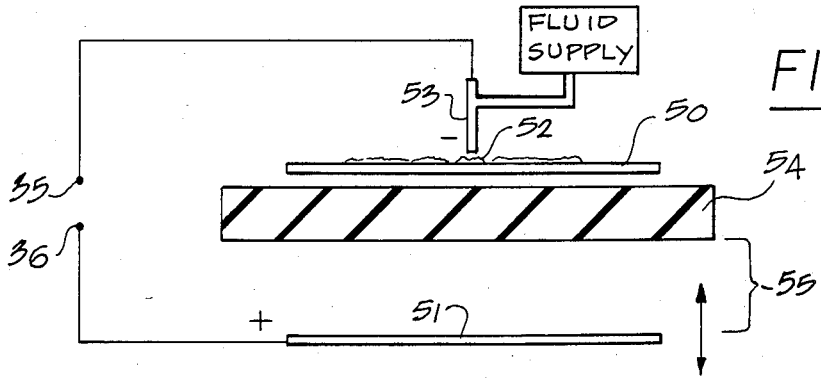

FIG. 5 is a diagrammatic view of still another version of the invention wherein the gap between the substrate 50 and the plate electrode 51 is occupied by a combination of insulative material 54 and an air gap represented by numeral 55. In the embodiment shown in FIGS. 3–5 inclusive, additional control means for temperature, humidity, vibration, gas introduction or the like may be added substantially as shown and described with respect to FIG. 2.

Figure 2:
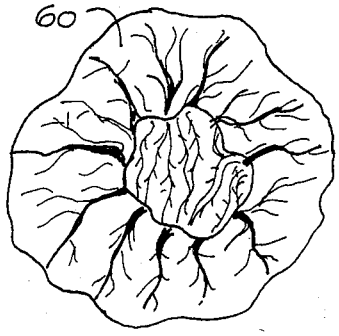
FIG. 2 is a plan view of a typical artistic rendering showing dendriform patterns or designs.

The end result of the use of the invention is an artistic rendering or graphic representation as illustrated in FIG. 2 by the numeral 60. The numeral 60 also represents the substrate on which the pattern is disposed and it can be seen that the pattern is tree-like in its formation and design wherein a central trunk disperses out into branches and twigs. Also, the design is sometimes described as web-like considering that its apearance will sometimes look like a spider web. The charged fluid solidifies after curing into a plurality of seemingly micro and macro dendriform lines. The cured fluid bonds or otherwise becomes integrally formed with the composition of the substrate at its surface.

In actual practice, a liquid is charged electrically on the substrate by one of the electrodes and then the charged liquid flows, diffuses or migrates towards the oppositely charged electrode or pole over the substrate surface. The liquid travels over the conductive or non-conductive substrate and is affected by the humidity, temperature, atmosphere and other conditions previously described within the working chamber of the cabinet 15. After the substrate composition, voltage levels as well as temperature and type of electrical field has been established, the liquid is subjected to the voltage and its polarity from the electrodes. The liquid then "grows" into the dendriform pattern as shown in FIG.

2 on the surface of the substrate. The electric fields can range in voltage from 240 volts upwards. The electric field types are positive direct current, negative direct current, alternating current from zero to 20 kilocycles, polarized alternating current from zero to 20 kilocycles, polarized pulsed alternating current from zero to 20 kilocycles, pulsed alternating current from zero to 20 kilocycles, and intermittent direct current. In one instance, a liquid constituting of a commercial paint is placed on a substrate and a negative 300 KV-DC voltage was applied to one electrode while the other electrode was at a substantially ground potential. The substrate was composed of a plastic material and a dendrite or dendriform pattern was created on the surface of the substrate surrounding the force filed of the electrode.

The practice of the invention in growing dendriform patterns can be accomplished in open ambient atmosphere or in the controlled confines of the cabinet 15. Preferably, an exhaust system may be incorporated for safety reasons to purge the work area of dangerous vapors or fumes.

Patterns may be developed on non-conductive substrates such as glass, plastic, wood, paper, cloth, stone, canvas, cardboard, foam core and many others. Because the liquid is charged, it tends to have enhanced penetration into the substrate. This increases the durability and bonding of the coloring agent or liquid to the substrate. In any event, curing will adhere the liquid to the substrate which may be achieved by drying, cooling, evaporation, polymerization or the like.

While particular embodiments of the present invention have been shown and described, it will be obvious to those skilled in the art that changes and modifications may be made without departing from this invention in its broader aspects and, therefore, the aim in the appended claim is to cover all such changes and modifications as fall within the true spirit and scope of this invention.

What is claimed is:

1. A generator for producing non-fibrous decorative dendriform patterns utilizing a flowable liquid comprising:

a substrate having a horizontal working surface: for receiving and supporting said flowable liquid on a localized area of said surface on which said patterns are formed from said liquid;

a support means for holding said substrate with its working surface horizontal means for depositing said flowable liquid on said localized area;

electrical means operable to create a charged force field about substrate supported flowable liquid said electrical means including a power supply operably coupled to a pair of electrodes for establishing said charged force field about said working surface localized area, and said electrical means operable to urge; said liquid to branch and spread from said localized area into said dendriform patterns; and said substrate being removably carried on said support means so that said working surface is horizontal and supportive of said flowable liquid in its unseparated entirety.

2. The generator as defined in claim 1 wherein:

said substrate carrying said flowable liquid is disposed between said electrodes.

3. The generator as defined in claim 1 wherein:

said substrate constitutes one of said electrodes.

4. The generator as defined in claim 1 wherein:

said depositing means is in close proximity to said substrate and comprises liquid metering means.

5. The generator as defined in claim 4 wherein:

said metering means is one of said electrodes.

6. The generator as defined in claim 5 including:

means connected to at least one of said electrodes for moving said electrodes relative to each other.

7. The generator as defined in claim 6 wherein:

said movable means includes a two piece electrode as one of said pair of electrodes operably coupled together by a rack and pinion mechanism.

8. The generator as defined in claim 1 wherein:

said charged force field ionizes said flowable liquid so that said liquid travels between said electrodes in accordance with electrostatic attraction principles.

9. The generator as defined in claim 8 wherein:

said liquid includes color pigmentation and is characterized as being curable to a solid state after distribution over said substrate to a desired configuration.

* * * * *